US011353300B2

(12) United States Patent
Murphy

(10) Patent No.: US 11,353,300 B2
(45) Date of Patent: Jun. 7, 2022

(54) MODULAR GAS OPERATED FIN DEPLOYMENT SYSTEM

(71) Applicant: Raytheon Company, Waltham, MA (US)

(72) Inventor: Timothy A. Murphy, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 171 days.

(21) Appl. No.: 16/840,817

(22) Filed: Apr. 6, 2020

(65) Prior Publication Data

US 2021/0310774 A1 Oct. 7, 2021

(51) Int. Cl.
*F42B 10/20* (2006.01)

(52) U.S. Cl.
CPC ..... *F42B 10/20* (2013.01)

(58) Field of Classification Search
CPC ..... F42B 10/20
See application file for complete search history.

(56) References Cited

U.S. PATENT DOCUMENTS 2,821,924 A * 2/1958 Hansen ..... F42B 10/20 244/3.28
6,880,780 B1 * 4/2005 Perry ..... F42B 10/14 244/3.27
8,253,085 B1 * 8/2012 Lichtenberg-Scanlan ..... F42B 10/20 244/3.27
9,086,259 B2 * 7/2015 Cleveland ..... F42B 10/20
9,702,673 B1 * 7/2017 Ginetto ..... F42B 10/20
10,641,590 B2 * 5/2020 Buttolph ..... F42B 10/18
2005/0082419 A1 * 4/2005 Dryer ..... F42B 30/12 244/3.3
2011/0186678 A1 * 8/2011 Sankovic ..... F42B 10/14 244/3.27

* cited by examiner

*Primary Examiner* — Justin M Benedik
(74) *Attorney, Agent, or Firm* — Renner, Otto, Boisselle & Sklar, LLP

(57) ABSTRACT

A projectile and deployment method ensures successful deployment of the projectile regardless of an external environment. Contacting engagement is maintained between a piston and deployable fins as the fins rotate from a folded position to a deployed position. The fins are pushed by the piston to rotate into a deployed position in which the fins are locked before the piston is able to eject from the assembly. Using the engaging tabs between the fins and the piston, and a modular pressure reservoir, the piston continues to push on the fins at least until the fins are deployed and locked. After locking, pressure in the projectile is equalized and the piston is launched off of the pressure reservoir. If the fins are not immediately deployed and locked, the piston will continue to push on the fins until the external environment enables full deployment or until the pressure is equalized.

20 Claims, 6 Drawing Sheets

MODULAR GAS OPERATED FIN DEPLOYMENT SYSTEM

GOVERNMENT LICENSE RIGHTS

This invention was made with Government support under contract number DOTC-17-01-INIT0987, awarded by the Department of Defense. The Government has certain rights in the invention.

FIELD OF THE INVENTION

The invention relates to munitions, more particularly, to tube-launched or gun-launched projectiles and methods of deploying projectiles.

DESCRIPTION OF THE RELATED ART

Projectiles that are launched by guns or tubes may be suitable for different applications. For example, military applications that use munitions may be a suitable application. The projectiles may include fins to increase the stability of the projectile during and after deployment of the projectile from the gun or tube. The projectile is fired from a muzzle or barrel of the gun by using propellant gas that fills a reservoir with pressure to actuate a piston of the projectile. The piston then imparts a force on the fins that causes rotation of the fins out of a folded position. The contact between the piston and the fins is brief and only over a few degrees of rotation of the fins.

When the piston is disengaged from the fins, the fins act against drag and friction from the external environment as the fins continue to rotate toward into the deployed position. In certain applications, the conditions of the external environment are not known or may change due to muzzle velocity, obturator leakage, or other factors. Conventional gun-launched projectiles may be deficient in that the fins are susceptible to stalling and failing to deploy when the projectile encounters the external environment and the contact between the piston and the fin has ended.

SUMMARY OF THE INVENTION

The present application provides a projectile and method of deploying a projectile that ensures successful deployment of the projectile regardless of an external environment for the projectile. The projectile is configured to maintain contacting engagement between an actuated piston and deployable fins as the fins rotate from a folded position to a deployed position. The fins are pushed by the piston to rotate into a deployed position in which the fins are locked before the piston is able to eject from the assembly. By way of providing engaging tabs between the fins and the piston, and selecting a pressure reservoir having a predetermined volume to actuate the piston, the projectile is configured to enable the piston to continue to push on the fins at least until the fins are deployed and locked. After the fins are deployed and locked, pressure in the projectile is equalized and the piston will be launched off of the pressure reservoir. If the fins are not immediately deployed and locked, the piston will continue to push on the fins until the external environment enables full deployment or until the pressure is equalized.

The fins are locked in an initial deployed position after a predetermined amount of rotation by spring-biased locking pins that are biased against the fins. The fins each may be formed to have a notch that receives a corresponding locking pin after the predetermined amount of rotation. When the fins are locked in the initial deployed position, the fins may be configured to further rotate in the same direction, or overrotate by way of the locking pin slightly pivoting within the notch. The contacting engagement between the fins and the piston is maintained for a predetermined amount of the fin overrotation to ensure positioning of the fins before the fins and the piston are disengaged and the piston is ejected from the assembly.

The contacting engagement between the fins and the piston is provided by obliquely angled tabs of the fins that extend radially inwardly and engage a fin retention mechanism of the piston. Advantageously, the fins tabs and the fin retention mechanism are directly engageable without providing additional linkages between the fins and the piston. The fin retention mechanism may include grooves that receive the fins tabs and piston tabs that extend radially outwardly from the piston and continuously contact contours of the fin tabs as the fins rotate. The fin tabs and the fin retention mechanism each may be integrally formed as a monolithic body with the fins and the piston, respectively.

The pressure reservoir and the piston also provide modularity of the projectile such that the projectile may be used in any environment. The modular pressure reservoir and piston each may be selected to provide a specific amount of pressure in the projectile and consequently ensure successful deployment of the projectile in a particular environment. The pressure reservoir may be releasably connected to a base of the projectile such that pressure reservoirs having different volumes may be implemented to meet the requirements of a particular environment. Similarly, the piston is configured to receive a removable orifice at a front end of the piston such that differently sized orifices may be provided.

According to an aspect of the invention, a projectile is configured to maintain contact between a piston and deployable fins until the piston is ejected.

According to an aspect of the invention, a projectile is configured to enable a piston to continue to push on deployable fins until the fins are deployed and locked before pressure in the projectile is equalized and the piston is ejected, or in the event that the fins are not deployed and locked, continue to push on the fins until an external environment enables full deployment or until the pressure is equalized.

According to an aspect of the invention, a projectile includes fins having integrally formed features that directly engage a piston during deployment.

According to an aspect of the invention, a projectile is configured to maintain contact between a piston and deployable fins during a predetermined amount of overrotation of the deployable fins after reaching a deployed position.

According to an aspect of the invention, a projectile is tube-launched or gun-launched by a propellant that burns to generate high pressure gas.

According to an aspect of the invention, a projectile includes a locking pin having a tapered tip that enables early engagement of the locking pin with a fin prior to the fin reaching a deployed position.

According to an aspect of the invention, a projectile includes a locking pin having venting slots to prevent gas from being trapped under the locking pin during deployment.

According to an aspect of the invention, a projectile includes a base, a pressure reservoir releasably connected to the base, a movable piston fluidly connected to the pressure reservoir, a plurality of fins rotatably connected to the base and movable by the piston from a folded position to a deployed position, and a plurality of fin tabs that are formed on the plurality of fins and configured to maintain contact with the piston until the fins have reached the deployed position.

According to an embodiment of any paragraph(s) of this summary, the projectile includes a plurality of locking pins that are supported in the base and configured to engage the fins when the fins are in the deployed position.

According to an embodiment of any paragraph(s) of this summary, the fins are configured to overrotate past an initial deployed position in which the locking pins first engage the fins, wherein the piston and the fin tabs are configured to maintain contact for a predetermined amount of overrotation of the fins.

According to an embodiment of any paragraph(s) of this summary, each of the fins have a notch configured to receive a corresponding one of the locking pins.

According to an embodiment of any paragraph(s) of this summary, each of the locking pins have a rounded head with a tapered tip and a plurality of venting slots formed on the rounded head.

According to an embodiment of any paragraph(s) of this summary, the fin tabs are obliquely angled relative to a central axis of the projectile.

According to an embodiment of any paragraph(s) of this summary, each of the fin tabs protrude in a radially inwardly direction from a corresponding one of the fins.

According to an embodiment of any paragraph(s) of this summary, each of the fin tabs are formed integrally with a corresponding one of the fins as a monolithic body.

According to an embodiment of any paragraph(s) of this summary, each of the fin tabs have a base end formed on a corresponding one of the fins, a tip end, and a tapering body that tapers from the base end to the tip end.

According to an embodiment of any paragraph(s) of this summary, the piston has a cylindrical housing that is axially slidable over the pressure reservoir and a fin retention mechanism that is formed on the cylindrical housing and configured to engage the fin tabs.

According to an embodiment of any paragraph(s) of this summary, the fin retention mechanism includes a plurality of piston tabs that extend radially outwardly from the cylindrical housing.

According to an embodiment of any paragraph(s) of this summary, the fin retention mechanism includes a circumferential flange that is axially spaced from the plurality of piston tabs to define a circumferential groove therebetween, wherein the fin tabs are configured to engage in the circumferential groove when the fins are in the folded position.

According to an embodiment of any paragraph(s) of this summary, the fin retention mechanism is formed integrally with the cylindrical housing as a monolithic body.

According to an embodiment of any paragraph(s) of this summary, the cylindrical housing includes a removable orifice at a front end of the piston, and wherein the fin retention mechanism is formed at a rear end of the piston.

According to an embodiment of any paragraph(s) of this summary, the projectile includes a propellant and a primer that are arranged externally to the projectile and configured to pressurize the pressure reservoir.

According to another aspect of the invention, a gun-launched projectile assembly includes a barrel, a cartridge that is arranged in the barrel and contains a propellant and a primer, and a projectile releasably arranged in the cartridge, wherein the projectile includes a removable pressure reservoir that is configured to be pressurized by the propellant gas, a movable piston fluidly connected to the pressure reservoir, a plurality of rotatable fins that are movable from a folded position to a deployed position by the piston after the pressure reservoir is pressurized to move the piston, and a plurality of fin tabs that are formed on the plurality of fins and configured to maintain contact with the piston until the fins have reached the deployed position.

According to still another aspect of the invention, a method of deploying a projectile includes inserting a pressure reservoir into a base, pressurizing the pressure reservoir to move a piston that is fluidly connected with the pressure reservoir, rotating a plurality of fins relative to the base from a folded position toward a deployed position by way of the piston pushing against the fins, and maintaining contact between the fins and the piston until the fins have reached the deployed position.

According to an embodiment of any paragraph(s) of this summary, the method includes rotating the fins to an initial deployed position, locking the fins at the initial deployed position, overrotating the fins past the initial deployed, and maintaining contact between the fins and the piston for a predetermined amount of overrotation of the fins.

According to an embodiment of any paragraph(s) of this summary, the method includes selecting the pressure reservoir from a plurality of pressure reservoirs having different sizes.

According to an embodiment of any paragraph(s) of this summary, the method includes selecting a piston orifice from a plurality of piston orifices having different sizes, inserting the piston orifice into a front end of the piston, and engaging the fins with the piston at a rear end of the piston.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

The principles described herein have particular application in munitions and munition deployment systems, such as in tube-launched or gun-launched projectiles. The projectile and method of deploying the projectile described herein may be suitable for use in military applications. Non-lethal applications and non-military applications may also be suitable, such as surveillance systems. The projectile is suitable for deployment in any environment and may be carried on any suitable platform. Exemplary environments include air, space, and sea, and exemplary platforms include aircraft, hypersonic or supersonic vehicles, land vehicles, or watercraft.

Figure 1:
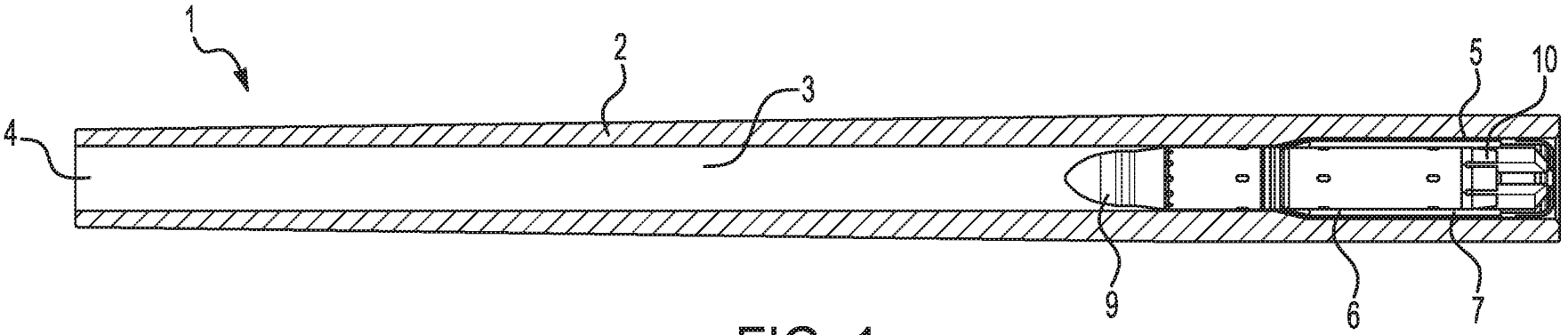
FIG. 1 shows a cross-sectional view of a gun-launched projectile assembly for launching a projectile.
Figure 2:
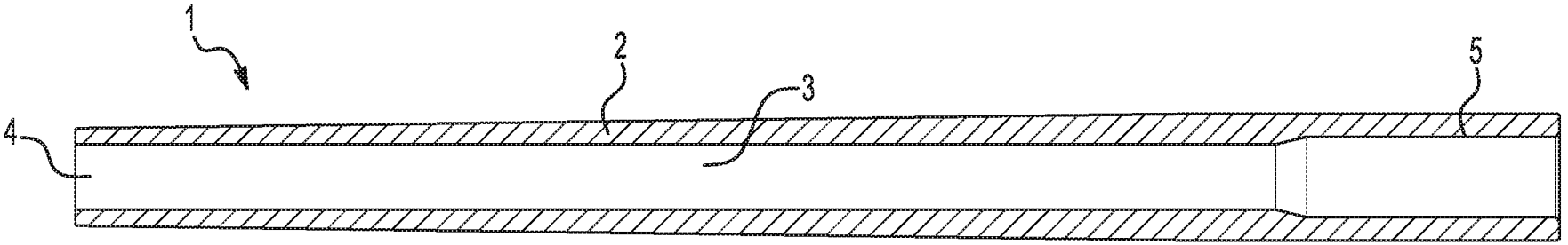
FIG. 2 shows a cross-sectional view of a barrel of the gun-launched projectile assembly of FIG. 1.

Referring first to FIGS. 1 and 2, the projectile described herein may be launched or deployed from a gun 1. The gun 1 includes a barrel 2 that defines a bore 3, a muzzle 4, and a chamber 5 that is arranged opposite to the muzzle 4 and is fluidly connected to the bore 3. The chamber 5 is configured to receive a cartridge 6, as shown in FIG. 1. The cartridge 6 includes a cartridge case 7 and a bullet 8 at a nose end of the cartridge 6.

Figure 3:
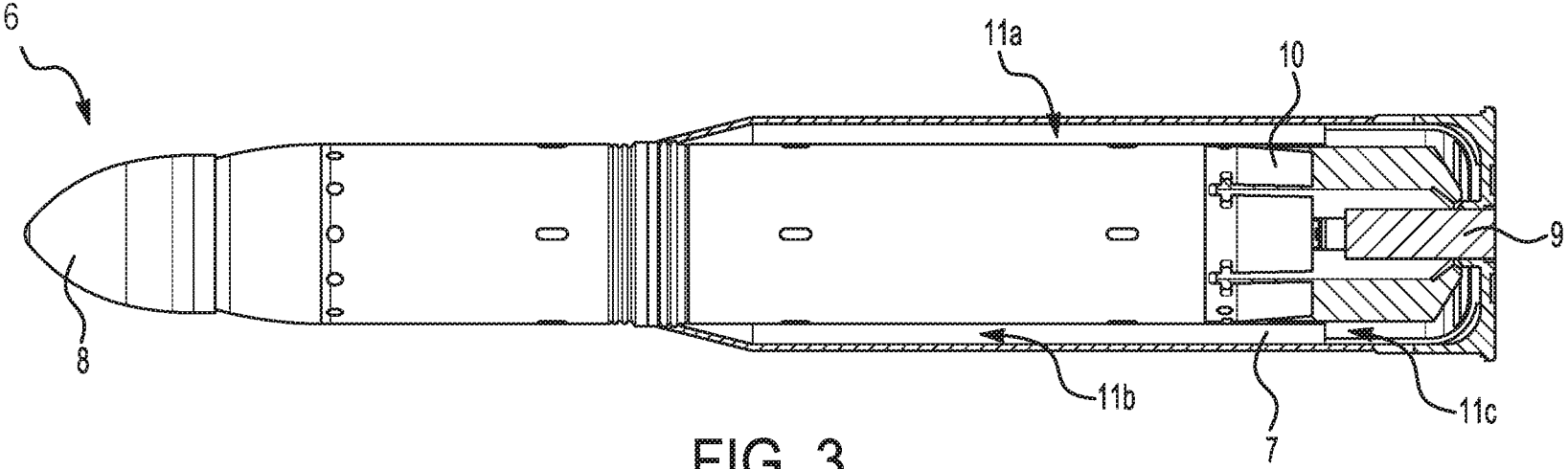
FIG. 3 shows a cross-sectional view of a projectile and cartridge of the gun-launched projectile assembly of FIG. 1.
Figure 4:
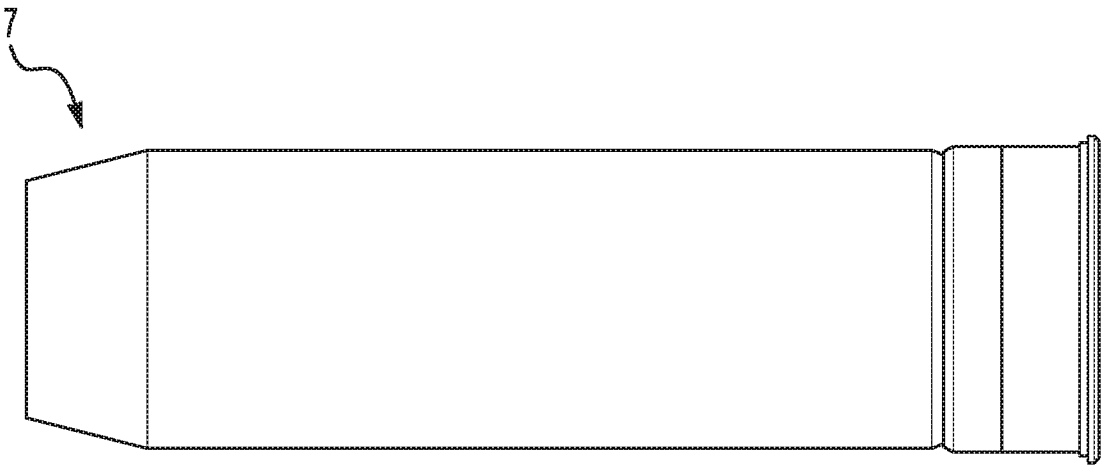
FIG. 4 shows an oblique view of the cartridge of FIG. 3.

Referring in addition to FIGS. 3 and 4, the cartridge case 7 may be cylindrical in shape and is configured to contain a primer 9, a round or projectile 10, and a propellant 11*a*, 11*b*, 11*c*. The projectile 10 is first loaded into the cartridge case 7. The gun 1 may be sized to support any suitable projectile as having any size as required for a particular application. For example, the projectile 10 may have a size as large as 155 millimeters. After insertion of the projectile 10, the propellant 11*a*, 11*b*, 11*c* is then inserted into the cartridge case 7 via a hole in the cartridge case 7 for insertion of the primer 9. The open volume in the cartridge case 7 that surrounds the projectile 10 is filled with the propellant 11*a*, 11*b*, 11*c*. The primer 9, which may be an eclectically initiated primer, is then inserted into the cartridge case 7.

After the cartridge case 7 is assembled, the cartridge 6 is inserted into the chamber 5 of the gun 1, as shown in FIG. 1. The projectile 10 is fired by initiating the primer 9 which causes the propellant 11*a*, 11*b*, 11*c* to burn thereby generating gas. The high pressure gas fills the cartridge case 7 and pushes the projectile 10 from the chamber 5 into the bore 3 of the gun 1. In an exemplary application, the cartridge case 7 may be consumed by the resulting fire from burning the propellant 11*a*, 11*b*, 11*c*. In another exemplary application, the projectile 10 may exit the cartridge case 7 and the chamber 5 at the same time such that the cartridge case 7 is retained in the chamber 5.

As described further below, the high pressure gas will flow through an orifice on a piston of the projectile 10 into a pressure reservoir of the projectile 10 until the pressures are equal. Upon a muzzle exit by the projectile 10, the differential pressure between the high pressure in the pressure reservoir versus a low ambient pressure of the external environment outside the gun 1 causes the piston to shear fasteners that secure the piston to the projectile 10. In other exemplary embodiments, the projectile 10 may be filed without a case or cartridge. For example, the projectile 10 itself may include a propellant, such as an explosive charge or ignitor contained in the pressure reservoir of the projectile 10.

Referring now to FIGS. 5-8, an exemplary embodiment of the projectile 10 is shown. The projectile 10 includes a tail base 12 that forms a rear end of the projectile 10 relative to a direction in which the projectile 10 is deployed from the gun. The projectile 10 may already have the base 12 attached to the projectile 10 when the projectile 10 is inserted into the cartridge case. The base 12 may be cylindrical in shape and is formed of any suitable material. For example, a metal such as aluminum may be suitable. The base 12 disengages from the cartridge case as part of the projectile 10 as the projectile 10 exits the cartridge case.

Figure 5:
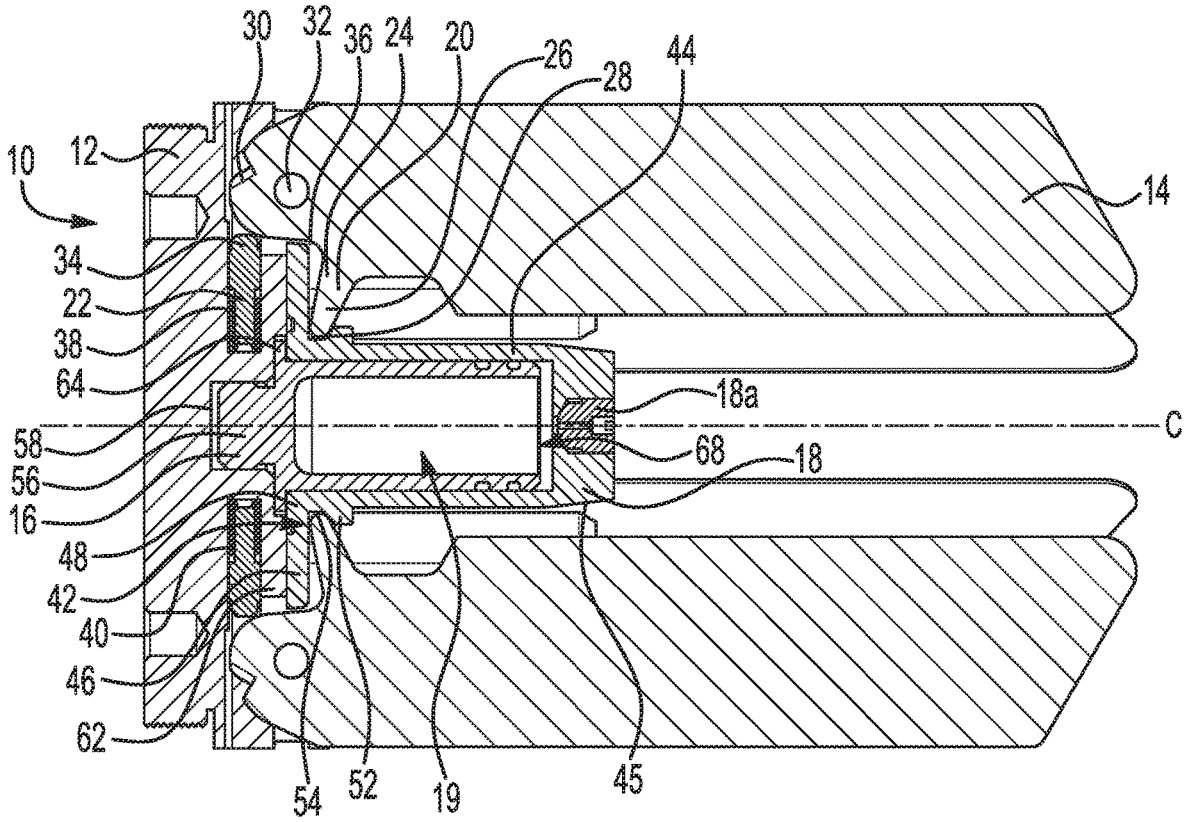
FIG. 5 shows a cross-sectional view of the projectile of FIG. 1 having fins in a folded position.
Figure 6:
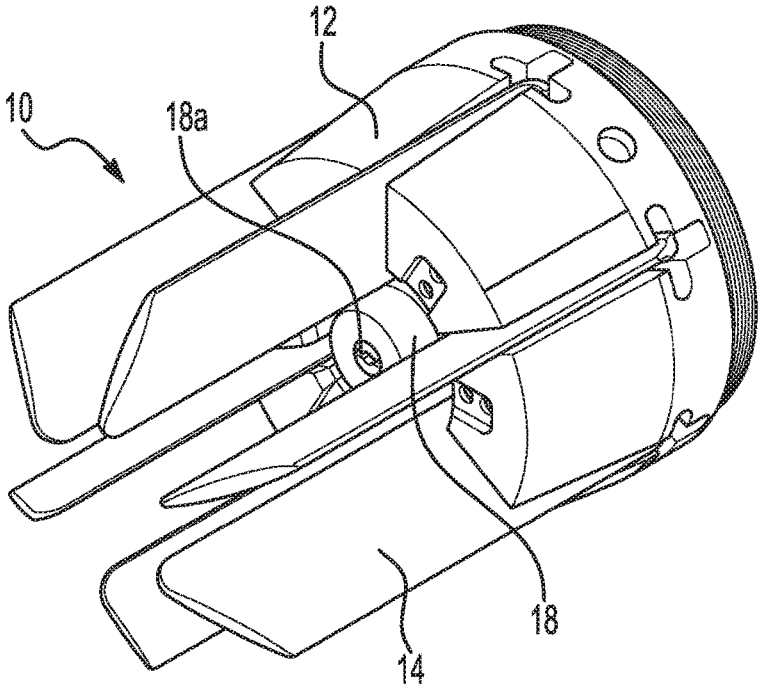
FIG. 6 shows a cross-sectional view of the projectile of FIG. 1 with the fins in a deployed position.
Figure 7:
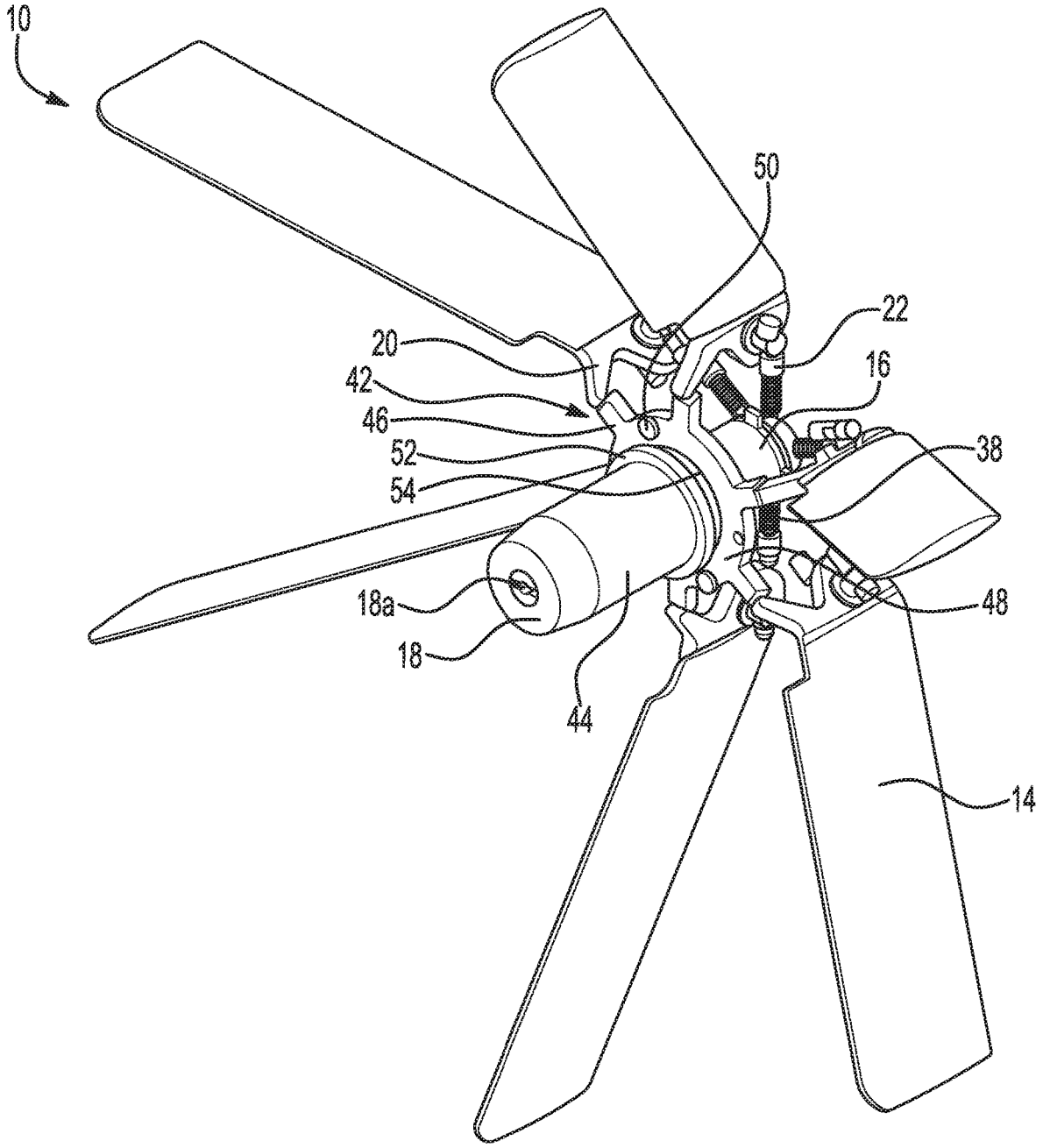
FIG. 7 shows an oblique view of the projectile of FIG. 1.
Figure 8:
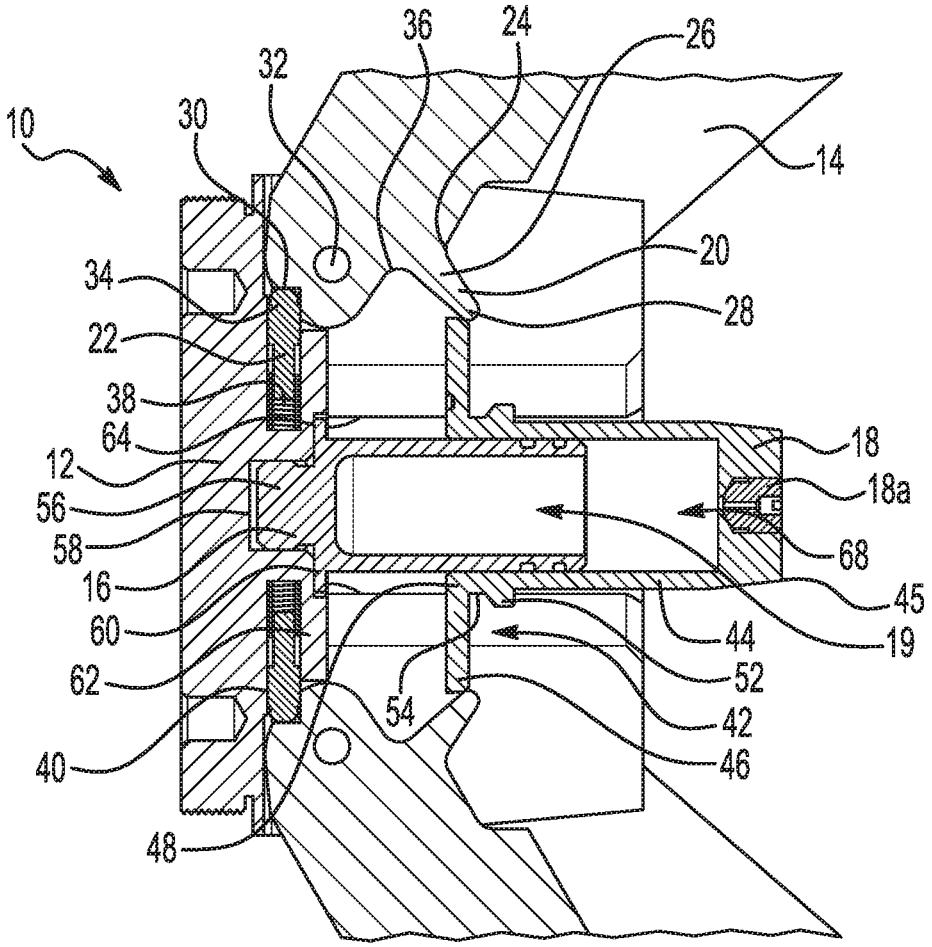
FIG. 8 shows an oblique view of the projectile of FIG. 1 with the fins in the deployed position and a base of the projectile removed.

A plurality of deployable fins 14 are rotatably connected to the base 12. FIGS. 5 and 6 show the projectile 10 in a stowed state in which the fins 14 are in a folded position. The fins 14 remain in the folded position until the entire projectile 10 has exited the muzzle of the gun. When the projectile 10 is launched from the gun to move from the stowed state to a deployed state, the fins 14 are rotatable relative to the base 12 to move from the folded position to a deployed position, as shown in FIGS. 7 and 8. FIG. 7 shows the projectile 10 with the base 12 removed to more clearly show some of the components of the projectile 10 during the deployed state. The fins 14 remain in the deployed position during the deployed state of the projectile 10.

Deployment of the projectile 10 is enabled by a removable or separable pressure reservoir 16 as best shown in FIGS. 5 and 8. The removable pressure reservoir 16 is supported in the base 12. A movable piston 18 is fluidly connected to a chamber 19 of the pressure reservoir 16. When the projectile 10 is in the stowed state, the pressure reservoir 16 may be configured to retain gas. During deployment of the projectile 10 into the external environment, an external pressure source, such as the propellant 11*a*, 11*b*, 11*c* contained in the cartridge case 7 of the gun 1, as shown in FIG. 3, is actuated by the primer 9 to pressurize the chamber 19. The high pressure propellant gas flows through an orifice 18*a* of the piston 18 to fill the pressure reservoir 16. The pressure reservoir 16 may be filled with the high pressure gas before the projectile 10 exits the gun 1.

The pressure of the propellant gas may be around 20,000 psi and the gas will flow through the orifice 18*a* into the pressure reservoir 16 until the pressures are equal. Upon the projectile 10 exiting the muzzle of the gun, the differential pressure between the pressurized chamber 19 and the external environment causes the piston 18 to move away from the base 12 in a forward or aft direction and begin to act on the fins 14. The base 12 holds the pressure reservoir 16 in place during movement of the piston 18 relative to the pressure reservoir 16. The piston 18 may be formed as a sleeve arranged over the pressure reservoir 16 such that the piston 18 axially slides along the pressure reservoir 16. In other exemplary embodiments, instead of an external propellant, the pressurization of the pressure reservoir 16 may instead be formed by an explosive charge or any suitable ignitor contained in the pressure reservoir 16 itself.

Movement of the piston 18 is imparted to the fins 14 by engaging surfaces that are formed between the fins 14 and the piston 18 to enable direct engagement therebetween. The piston 18 pushes the fins 14 from the folded position shown in FIGS. 5 and 6 toward the deployed position shown in FIGS. 7 and 8. In an exemplary embodiment of the projectile 10, the engagement between the fins 14 and the piston 18 is provided by a plurality of fin tabs 20 that are formed on the fins 14, as shown in FIGS. 5, 7 and 8. As shown by comparing FIG. 5 to FIG. 8, the fin tabs 20 are configured to maintain contact with the piston 18 starting from the folded position to the deployed position.

The fins 14 may have multiple deployed positions such that the fins 14 have an initial deployed position in which the fins 14 may be locked to prevent backwards rotation of the fins 14 toward the folded position. FIGS. 7 and 8 show the initial deployed position of the fins 14 after a predetermined amount of rotation. When the fins 14 have reached the initial deployed position, spring-biased locking pins 22 are arranged to engage the fins 14. The fins 14 and the locking pins 22 are configured to enable the fins 14 to rotate further past the initial deployed position into a final deployed position, which is also referred to as an overrotation of the fins 14. The overrotation may be between one and five degrees. The engaging surfaces of the fin tabs 20 and the piston 18 are formed to maintain contact for a predetermined amount of overrotation of the fins 14, such as for several degrees of rotation, to further ensure that the fins 14 are in a deployed position before the piston 18 is able to eject. The piston 18 is ejected from the assembly to reduce the weight of the projectile 10 during travel.

The fin tabs 20 and the fins 14 each may be formed to have any suitable shape. All of the fins 14 may be the same in shape and size and all of the fin tabs 20 may also be the same in shape and size. Any number of fins 14 and fin tabs 20 may be provided and the number of fins 14 may be dependent on the application. For example, between four and eight fins may be suitable. More than eight fins may also be suitable for particular applications. Each fin 14 may have one fin tab 20, but more than one fin tab 20 may be provided in other exemplary embodiments.

The fins 14 may each have an elongated body that extends in the forward direction from the base 12 when in the folded position. A length of the fins 14 in the forward direction is longer than a width of the fins 14. The thickness of the fins 14 is less than the length and the width. Any suitable material may be used to form the fins. For example, a metal material such as steel may be suitable. The fin tabs 20 are formed of the same material as the fins 14. In an exemplary embodiment, the fin tabs 20 may be formed integrally with the fins 14 as a monolithic body. In still other exemplary embodiments, the fin tabs 20 may be formed separately and subsequently attached to the fins 14.

Each fin tab 20 is obliquely angled relative to a central axis C of the projectile 10, as denoted in FIG. 5, when the fins 14 are in the folded position or in the deployed position. The central axis C may also define the forward and rear direction of travel of the projectile 10. When in the folded position, the length of the fins 14 extends substantially parallel to the central axis C such that the fin tabs 20 are also angled relative to the fins 14. The fin tabs 20 protrude radially inwardly from a corresponding fin 14 and toward the central axis C. A base end 24 of the fin tab 20 is formed along the fin 14 and defines a location where the fin tab 20 protrudes from the fin 14. The contours of the fin 14 and the fin tab 20 may be continuous relative to each other.

The fin tab 20 may have a tapering body 26 that tapers from the base end 24 to a tip end 28 of the fin tab 20. A length of the tapering body 26 may be longer than the width of the base end 24 and the width of the tip end 28. The width of the tapering body 26 may decrease along its length from the base end 24 to the tip end 28. When the fin 14 is in the folded position, the fin tab 20 may extend farther than the width of the fin 14 to ensure engagement with the piston 18, such that the tip end 28 of the fin tab 20 is a most radially inward surface of the fin 14. The fin tabs 20 may be formed to have rounded or non-sharp edges or contours to enable traveling movement of the piston 18 along the periphery of the fin tabs 20. Thus, the tip end 28 of the fin tab 20 may be curved or rounded.

The fins 14 are also formed to have an engagement surface for the locking pins 22. In an exemplary embodiment, an indent or notch 30 may be formed along a peripheral surface of each fin 14 for receiving a corresponding locking pin 22. The notch 30 may be formed proximate a pivot axis 32 of the fin 14 that is arranged at a rear end of the fin 14 and the notch 30 may be formed at a rearmost end of the fin 14. Any suitable support device may be used to form the pivot axis 32 between the fin 14 and the base 12. For example, a pin may form the pivot axis 32. As best shown in FIG. 8, the notch 30 is shaped to accommodate a head 34 of the locking pin 22 and to also enable pivoting movement of the locking pin 22 within the notch 30 during overrotation of the fin 14.

Figure 9:
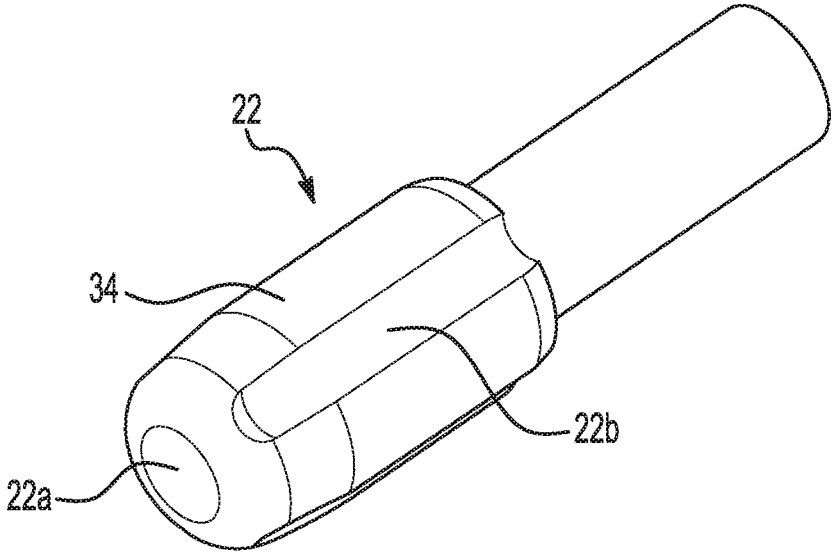
FIG. 9 shows an oblique view of a locking pin for the projectile of FIG. 1.
Figure 10:
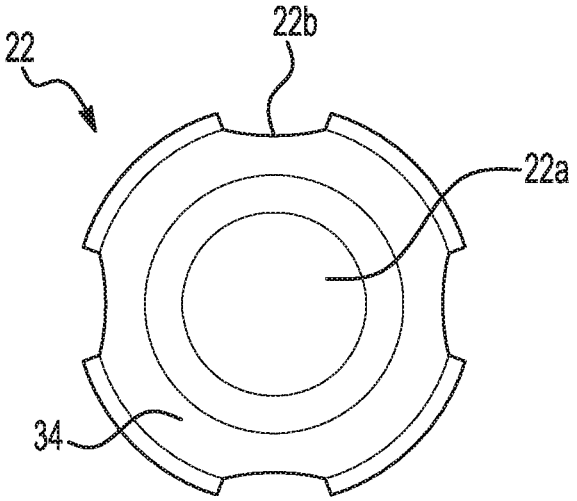
FIG. 10 shows a top view of the locking pin of FIG. 9.

Referring in addition to FIGS. 9 and 10, the head 34 of the locking pin 22 may be rounded such that the notch 30 may slightly pivot along the head 34 of the locking pin 22, while the locking pin 22 remains in a seated position against the fin 14. The locking pin 22 may also be tapered at a tip end **22*a* to enable engagement with the notch 30 that begins prior to the fin 14 reaching the initial deployed position. Venting slots 22*b* are also formed to axially extend along the head 34 of the locking pin 22. The venting slots 22*b* prevent gas from being trapped under the locking pin 22 in the base 12. Any suitable number of venting slots 22*b* may be provided, such as between two and six, and the venting slots 22*b* may be evenly distributed about the head 34**.

As shown in FIG. 8, the notch 30 may have any suitable shape for capturing the locking pin 22. A rectangular cutout or a curved rectangular cutout shape having a sharp corner may be suitable to ensure a locking surface between the locking pin 22 and the fin 14. The notch 30 may be axially and radially spaced relative to a corresponding fin tab 20 for the fin 14 such that the notch 30 and the fin tab 20 are arranged on different sides of the fin 14. In an exemplary embodiment, the notch 30 may be arranged on a rear side of the pivot axis 32 and the fin tab 20 may be formed on a front side of the pivot axis 32 that is opposite to the rear side.

A continuous curved contour 36 of the fin 14 may extend between the notch 30 and the base end 24 of the fin tab 20. The locking pin 22 may be engageable along the curved contour 36 until the locking pin 22 is received and seated in the notch 30. When the fin 14 is in the folded position, the head 34 of the locking pin 22 may be biased against the curved contour 36 by a biasing spring 38 that is supported in the base 12 and configured to bias the locking pin 22 toward the fin 14. One end of the biasing spring 38 engages against the base 12 and the opposite end of the biasing spring 38 engages the fin 14. As shown in FIGS. 5 and 8, the base 12 may define a radially extending slot 40 that opens to the rear end of the fin 14 and supports the biasing spring 38 and the locking pin 22 for movement relative to the rear end of the fin 14. The slot 40 may extend perpendicular relative to the central axis C of the projectile 10 such that the locking pin 22 is confined to movement in the perpendicular direction.

The curved contour 36 of the fin 14 may extend over a fin retention mechanism 42 of the piston 18 that is formed at a rear end of the piston 18 and extends from a cylindrical housing 44 of the piston 18. The cylindrical housing 44 extends along the central axis C of the projectile 10 and radially surrounds the pressure reservoir 16. The cylindrical housing 44 may have an aerodynamic shape, such as a tapering nose 45 to ensure forward movement of the piston 18 during deployment. The fin retention mechanism 42 is formed on the cylindrical housing 44 and may have any suitable shape to ensure direct contact between the fins 14 and the piston 18 without additional mechanical linkages. In an exemplary embodiment, the cylindrical housing 44 and the fin retention mechanism 42 may be integrally formed as a monolithic body. In other exemplary embodiment, the fin retention mechanism 42 may be formed separately and subsequently attached to the cylindrical housing 44 of the piston 18.

In an exemplary embodiment, the fin retention mechanism 42 may include a plurality of piston tabs 46 that extend radially outwardly from the cylindrical housing 44 toward the central axis C. The piston tabs 46 may extend perpendicular to the cylindrical housing 44 and the fin tabs 14 may be angled relative to the piston tabs 46. An radially outermost end of the piston tabs 46 may define the radially outermost surface of the piston 18. The piston tabs 46 may be formed on a plate 48 of the piston 18. As shown in FIG. 8, the piston tabs 46 may extend from an outer circumference of the plate 48. The plate 48 may have an outer circumference that is greater than an outer circumference of the cylindrical housing 44.

The piston tabs 46 may have any suitable shape and any number of piston tabs 46 may be provided. If each fin 14 has one fin tab 20, the number of piston tabs 46 may correspond to the number of fins 14 such that each fin tab 20 is engageable with a corresponding piston tab 46. The piston tabs 46 may be rectangular in shape, but other shapes may also be suitable. The piston 18 may be secured to the base 12 using any suitable fasteners that are releasable during ejection of the piston 18. For example, the plate 48 of the piston 18 may be configured to support at least two retaining screws 50 that secure the piston 18 to the base 12, as shown in FIG. 8. In contrast to conventional projectiles that include additional components for securing the piston 18 to the base 12, the projectile 10 may advantageously only use the retaining screws 50. During pressurization of the pressure reservoir 16, the pressure causes the piston 18 to shear the retaining screws 50 such that the piston 18 starts moving in the forward direction and is able to drop from the projectile 10 after the fins 14 are fully deployed.

In an exemplary embodiment, the fin retention mechanism 42 further includes a circumferential flange 52 formed on the cylindrical housing 44. The circumferential flange 52 is axially spaced from the plate 48 to define a circumferential groove 54 between the circumferential flange 52 and the plate 48. As shown in FIG. 5, the tip ends 28 of the fin tabs 20 are configured to engage in the circumferential groove 54 such that the fin tabs 20 may be seated in the circumferential groove when the fins 14 are in the folded position. As the fin 14 is moved by movement of the piston 18 in the forward direction, the rounded tip end 28 of the fin tab 20 pivots in the circumferential groove 54 until the tip end 28 moves out of the circumferential groove 54 and the piston tab 46 engages the tapering body 26 of the fin tab 20. Thus, a surface of the tip end 28 is always contacting a surface of the piston 18 during deployment.

As shown in FIG. 8, the tip end 28 of the fin tab 20 again engages with the fin retention mechanism 42 when the fin 14 reaches the initial deployed position and the tip end 28 is engaged against the piston tab 46. During movement of the fin 14 from the folded position to the deployed position, the piston tab 46 moves along a rear edge of the tapering body 26 of the fin tab 20 such that the curved contour 36 is rotated over the piston tab 46. During forward axial movement of the piston 18, the piston tab 46 follows the tapering body 26 of the fin tab 20 from the base end 24 to the tip end 28 of the fin tab 20 such that the piston tab 46 engages the tip end 28 right before the piston 18 is ejected.

The engagement between the tip end 28 and the piston tab 46 is configured to enable the overrotation of the fin 14. For example, the fin 14 may be rotatable in a rotational direction, either clockwise or counterclockwise, about the pivot axis 32 starting from the folded position. After the piston 18 has pushed the fin 14 to rotate a predetermined number of degrees, such that the fin 14 has a first rotational range, the fin 14 reaches the initial deployed position in which the locking pin 22 first engages in the notch 30.

The piston 18 is engaged with the fin 14 during the entire first rotational range. In contrast, in a conventional projectile which is not configured to maintain contact between the piston 18 and the fin 14, the fin 14 may stop rotating between 20 and 25 degrees such that the fin would never reach the deployed position and deployment would fail. The projectile 10 may be formed to enable any first rotational range for the fins 14. For example, the first rotational range may be approximately 59 degrees. Other first rotational ranges are suitable, such that the fins 14 may rotate fewer than 59 degrees or more than 59 degrees to reach the initial deployed position.

When the fin 14 reaches the initial deployed position at the end of the first rotational range, the engagement between the piston tab 46 and the fin tab 20 is formed to maintain engagement between the piston 18 and the fin 14 for at least several more degrees of rotation of the fin 14 in the same rotational direction during a second rotational range, i.e. the fin overrotation. The piston 18 is engaged with the fin 14 for the entire second rotational range. For example, the second rotational range may be approximately one degree, such that the fin 14 is rotated to 60 degrees. The second rotational range may be greater than one degree. After the fin 14 has rotated through the second rotational range, the piston tab 46 may then disengage from the fin tab 20 such that the piston 18 is disengaged from the fin 14 and is able to eject. After disengaging from the piston 18, the fin 14 may be in the fully deployed position, such as at 60 degrees of rotation, or the fin 14 may also continue to rotate toward the fully deployed position, by way of the aerodynamic drag acting on the fins 14.

In addition to engagement between the fins 14 and the piston 18, the pressure reservoir 16 is formed to provide a desired amount of pressure for the projectile 10 that ensures successful deployment of the projectile 10. In contrast to conventional projectiles 10, the pressure reservoir 16 is configured to be removably inserted into the base 12 such that different sized pressure reservoirs 16 may be implemented in the projectile 10. The pressure reservoir 16 is formed to extend along the central axis C and may be formed of any suitable material. For example, the pressure reservoir 16 may be formed of a metal such as aluminum. The volume of the chamber 19 varies in different pressure reservoirs 16 such that the projectile 10 may be tuned for different environments.

Using the removable or interchangeable pressure reservoir 16 is advantageous in enabling modularity of the projectile 10 and any suitable securement device may be used to removably secure the selected pressure reservoir 16 to the base 12. For example, the pressure reservoir 16 may include a head portion 56 at the rear end of the pressure reservoir 16 that is configured for threaded engagement with a corresponding receiving aperture 58 formed in the base 12, as shown in FIGS. 5 and 8. Locating tabs 60 may extend radially outwardly from the pressure reservoir 16 and are engageable against the base 12 to limit axial movement of the pressure reservoir 16 when assembled. The plate 48 of the piston 18 may form a rear end of the piston 18 that is axially engageable against the locating tabs 60 of the pressure reservoir 16 when the projectile 10 is in the stowed state.

The base 12 may also define a radially extending wall 62 that faces the slot 40 for the locking pin 22 on a rear side of the wall 62 and is engageable by the plate 48 of the piston 18 on a front side of the wall 62. Thus, the wall 62 limits axial movement of the piston 18 in the rear direction when assembled. The wall 62 may also define a notch 64 that receives the locating tabs 60 of the pressure reservoir 16. The base 12 is formed to retain a position of the pressure reservoir 16 during movement of the piston 18 over the pressure reservoir 16.

The piston 18 is formed to enable further modularity of the projectile 10 for different environments. The orifice 18*a* of the piston 18 is removably inserted at a front end of the piston 18 opposite the rear end where the fin retention mechanism 42 is formed. The piston orifice 18*a* is fluidly connected to the chamber 19 of the pressure reservoir 16 via a piston chamber 68 that is defined by the cylindrical housing 44 of the piston 18 and expands when the chamber 19 is pressurized. An orifice having a predetermined diameter may be selected for a particular application from a plurality of orifices having diameters with different sizes. Thus, the interchangeable orifice enables further control of the pressure differential of the projectile 10 during deployment in different environments.

Figure 11:
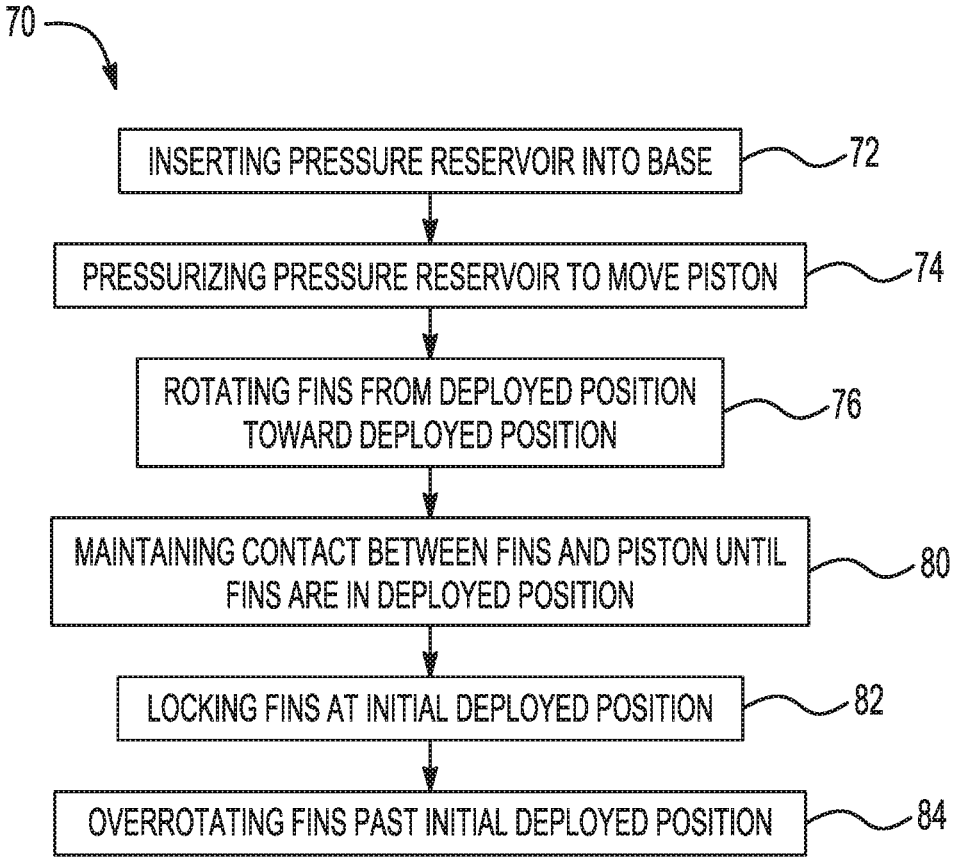
FIG. 11 shows a flowchart for a method of deploying a projectile such as the projectile of FIG. 1.

Referring now to FIG. 11, a flowchart showing a method 70 of deploying a projectile, such as the projectile 10 shown in FIGS. 5-8 and described herein. Step 72 of the method 70 includes inserting the pressure reservoir 16 into the base 12 of the projectile 10. Step 72 may include selecting the pressure reservoir 16 from a plurality of pressure reservoirs having different sizes. Step 74 of the method 70 includes pressurizing the pressure reservoir 16 to move the piston 18 that is fluidly connected with the pressure reservoir 16. Step 74 may include selecting a piston orifice 18*a* from a plurality of piston orifices having different sizes, inserting the piston orifice 18*a* into the front end of the piston 18, and engaging the fins 14 with the piston 18 at a rear end of the piston 18. The components of the projectile 10 including the base 12, the pressure reservoir 16, the piston 18, and the fins 14 may be formed using any suitable manufacturing processes, such as additive manufacturing processes, conventional manufacturing processes, or a combination thereof.

Step 76 of the method 70 includes rotating the fins 14 relative to the base 12 from the folded position toward the deployed position. The fins 14 are rotated via pushing by the piston 18 against the fins 14. Step 76 may include rotating the fins 14 to an initial deployed position. Step 80 of the method 70 includes maintaining contact between the fins 14 and the piston 18 until the fins 14 have reached the deployed position. Step 80 may include maintaining contact between fin tabs 20 and the fin retention mechanism 42 of the piston 18. Step 82 of the method 70 includes locking the fins 14 at the initial deployed position and step 84 includes overrotating the fins 14 past the initial deployed position. Step 84 may include maintaining contact between the fins 14 and the piston 18 for a predetermined amount of overrotation of the fins 14.

The projectile and method of deploying the projectile described herein enables successful deployment of any suitable projectile regardless of the external environment. In contrast to conventional projectiles, the projectile described herein provides varying fin rotation speed, varying pressure reservoir volume, and an increase in duration of contact between the piston and the fins. In an exemplary application, the projectile may be suitable for gun environments having a muzzle velocity that is between 400 and 700 meters per second, a base pressure that is between 16,000 and 28,000 psi, and setback accelerations between 6,000 and 10,000 g's. Many other gun environments may be suitable.

The configuration of the engaging surfaces between the piston and the fins provides a same effect as a mechanical linkage without providing a mechanical linkage that would require small precision machined parts that may not be able to be made strong enough for particular applications. The interface between the piston and the fins ensures that the fins rotate into the locked position before the piston is ejected from the assembly. If debris or other friction increasing contaminants impede deployment, the pressurized piston continues to push the fins until the internal gas pressure has bled off or the fins are deployed. Additionally, the modular pressure chamber enables tuning of the system for different launch environments and applications such that part changes are minimized.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A projectile comprising:

a base;

a pressure reservoir releasably connected to the base;

a movable piston fluidly connected to the pressure reservoir;

a plurality of fins rotatably connected to the base and movable by the piston from a folded position to a deployed position; and a plurality of fin tabs that are formed on the plurality of fins and configured to maintain contact with the piston until the fins have reached the deployed position;

wherein the piston has a cylindrical housing that is axially slidable over the pressure reservoir and a fin retention mechanism that is formed on the cylindrical housing and configured to engage the fin tabs.

2. The projectile according to claim 1 further comprising a plurality of locking pins that are supported in the base and configured to engage the fins when the fins are in the deployed position.

3. The projectile according to claim 2, wherein each of the fins have a notch configured to receive a corresponding one of the locking pins.

4. The projectile according to claim 2, wherein each of the locking pins have a rounded head with a tapered tip and a plurality of venting slots formed on the rounded head.

5. The projectile according to claim 1, wherein the fin tabs are obliquely angled relative to a central axis of the projectile.

6. The projectile according to claim 1, wherein each of the fin tabs protrude in a radially inwardly direction from a corresponding one of the fins.

7. The projectile according to claim 1, wherein each of the fin tabs are formed integrally with a corresponding one of the fins as a monolithic body.

8. The projectile according to claim 1, wherein each of the fin tabs have a base end formed on a corresponding one of the fins, a tip end, and a tapering body that tapers from the base end to the tip end.

9. The projectile according to claim 1, wherein the fin retention mechanism includes a plurality of piston tabs that extend radially outwardly from the cylindrical housing.

10. The projectile according to claim 9, wherein the fin retention mechanism includes a circumferential flange that is axially spaced from the plurality of piston tabs to define a circumferential groove therebetween, wherein the fin tabs are configured to engage in the circumferential groove when the fins are in the folded position.

11. The projectile according to claim 1, wherein the fin retention mechanism is formed integrally with the cylindrical housing as a monolithic body.

12. The projectile according to claim 1, wherein the cylindrical housing includes a removable orifice at a front end of the piston, and wherein the fin retention mechanism is formed at a rear end of the piston.

13. The projectile according to claim 1 further comprising a propellant and a primer that are arranged externally to the projectile and configured to pressurize the pressure reservoir.

14. A projectile comprising:

a base;

a pressure reservoir releasably connected to the base;

a movable piston fluidly connected to the pressure reservoir;

a plurality of fins rotatably connected to the base and movable by the piston from a folded position to a deployed position;

a plurality of fin tabs that are formed on the plurality of fins and configured to maintain contact with the piston until the fins have reached the deployed position; and a plurality of locking pins that are supported in the base and configured to engage the fins when the fins are in the deployed position;

wherein the fins are configured to overrotate past an initial deployed position in which the locking pins first engage the fins, wherein the piston and the fin tabs are configured to maintain contact for a predetermined amount of overrotation of the fins.

15. The projectile according to claim 14, wherein the piston has a cylindrical housing that is axially slidable over the pressure reservoir and a fin retention mechanism that is formed on the cylindrical housing and configured to engage the fin tabs.

16. A gun-launched projectile assembly comprising:

a barrel;

a cartridge that is arranged in the barrel and contains a propellant and a primer; and a projectile releasably arranged in the cartridge, wherein the projectile includes a removable pressure reservoir that is configured to be pressurized by the propellant gas, a movable piston fluidly connected to the pressure reservoir, a plurality of rotatable fins that are movable from a folded position to a deployed position by the piston after the pressure reservoir is pressurized to move the piston, and a plurality of fin tabs that are formed on the plurality of fins and configured to maintain contact with the piston until the fins have reached the deployed position, wherein the piston has a cylindrical housing that is axially slidable over the pressure reservoir and a fin retention mechanism that is formed on the cylindrical housing and configured to engage the fin tabs.

17. A method of deploying a projectile, the method comprising:

inserting a pressure reservoir into a base;

pressurizing the pressure reservoir to move a piston that is fluidly connected with the pressure reservoir;

rotating a plurality of fins relative to the base from a folded position toward a deployed position by way of the piston pushing against the fins; and maintaining contact between the fins and the piston until the fins have reached the deployed position; and further comprising:

selecting a piston orifice from a plurality of piston orifices having different sizes;

inserting the piston orifice into a front end of the piston; and engaging the fins with the piston at a rear end of the piston.

18. The method according to claim 17 further comprising:

rotating the fins to an initial deployed position;

locking the fins at the initial deployed position;

overrotating the fins past the initial deployed; and maintaining contact between the fins and the piston for a predetermined amount of overrotation of the fins.

19. The method according to claim 17 further comprising selecting the pressure reservoir from a plurality of pressure reservoirs having different sizes.

20. The method according to claim 17, wherein the projectile includes a plurality of fin tabs that are formed on the plurality of fins and configured to maintain contact with the piston until the fins have reached the deployed position; and wherein the piston has a cylindrical housing that is axially slidable over the pressure reservoir and a fin retention mechanism that is formed on the cylindrical housing and configured to engage the fin tabs.

* * * * *